US007150772B2

(12) United States Patent
Larsson et al.

(10) Patent No.: US 7,150,772 B2
(45) Date of Patent: Dec. 19, 2006

(54) CVD COATED CUTTING TOOL INSERT

(75) Inventors: Andreas Larsson, Fagersta (SE); Anette Sulin, Fagersta (SE); Lena Petersson, Vattholma (SE); Sakari Ruppi, Fagersta (SE)

(73) Assignee: Seco Tools AB, Fagersta (SE)

( * ) Notice: Subject to any disclaimer, the term of this patent is extended or adjusted under 35 U.S.C. 154(b) by 209 days.

(21) Appl. No.: 10/847,467

(22) Filed: May 18, 2004

(65) Prior Publication Data

US 2005/0037203 A1 Feb. 17, 2005

(30) Foreign Application Priority Data

Jun. 16, 2003 (SE) ..... 0301742

(51) Int. Cl.
*C23C 16/30* (2006.01)

(52) U.S. Cl. ..... 51/309; 51/307; 428/216; 428/336; 428/325; 428/698; 428/701

(58) Field of Classification Search ..... 51/307, 51/309; 426/216, 336, 325, 698, 701
See application file for complete search history.

(56) References Cited

U.S. PATENT DOCUMENTS

| | | | | |
|---|---|---|---|---|
| 6,062,776 | A * | 5/2000 | Sandman et al. | 428/216 |
| 6,177,178 | B1 * | 1/2001 | Ostlund et al. | 428/216 |
| 6,221,479 | B1 * | 4/2001 | Waldenstrom et al. | 428/325 |
| 6,250,855 | B1 * | 6/2001 | Persson et al. | 428/216 |
| 6,251,508 | B1 * | 6/2001 | Ruppi | 428/698 |
| 6,632,514 | B1 * | 10/2003 | Sulin et al. | 428/701 |
| 6,733,874 | B1 * | 5/2004 | Ueda et al. | 428/336 |

* cited by examiner

*Primary Examiner*—Archene Turner
(74) *Attorney, Agent, or Firm*—Drinker Biddle & Reath LLP

(57) ABSTRACT

The present invention relates to a coated cemented carbide insert (cutting tool), particularly useful for milling of stainless steels and super alloys but also milling of steels in toughness demanding applications. The cutting tool insert is characterised by a cemented carbide body comprising WC, NbC and TaC, a W-alloyed Co binder phase, and a coating comprising an innermost layer of $TiC_xN_yO_z$ with equiaxed grains, a layer of $TiC_xN_yO_z$ with columnar grains and a layer of $\alpha$-$Al_2O_3$.

10 Claims, 1 Drawing Sheet

CVD COATED CUTTING TOOL INSERT

BACKGROUND OF THE INVENTION

The present invention relates to a coated cemented carbide insert (cutting tool), particularly useful for milling of stainless steels and super alloys but also milling of steels in toughness demanding applications.

During milling of various materials with coated cemented carbide cutting tools, the cutting edges are regarded as being worn according to different wear mechanisms. Wear types such as chemical wear, abrasive wear and adhesive wear, are rarely encountered in a pure state, and complex wear patterns are often the result. The domination of any of the wear mechanisms is determined by the application, and is dependent on both properties of the work piece and applied cutting parameters as well as the properties of the tool material. At high cutting speeds, the amount of heat generated in the cutting zone is considerable and a plastic deformation of the cutting edge may occur, which in turn yields an enhanced wear by other mechanisms. The tool life is also often limited by edge chipping caused by so-called comb cracks that form perpendicular to the cutting edge. The cracks originate from the varying thermal and mechanical loads that the cutting edge is subjected to during the intermittent cutting process. This is often even more evident in machining with coolant, which enhances the thermal variations.

Many stainless steels in general, and super alloys in particular, possess material properties that are most unfavorable from a machinability point of view, when compared to steels. The low thermal conductivity of these materials results in high temperatures in the tool and work piece contact zones. The use of coolant to reduce the tool temperature can give very large thermal variations and induce high internal tool loads. These work piece materials are also often prone to deformation hardening. Deformation hardening of the work piece in the cutting zone can result in high cutting forces, or even cutting in a hardened layer, which both will lead to accelerated tool wear. Furthermore, most stainless steels and superalloys show good adherence towards many coating materials and adhesive wear and rapid chipping of the tool edge due to re-cutting of chips can be substantial. It is thus clear that coated cemented carbide tools intended for use in milling of stainless steels and super alloys must have properties often extending those that are generally needed for tool materials.

In general, measures can be taken to improve the cutting performance with respect to a specific wear type. However, very often such actions will have a negative effect on other wear properties and successful tool composite materials must be designed as careful optimisations of numerous properties. A simple measure to increase the toughness often needed for milling tools is to increase the binder phase content. However, this will also quickly reduce the wear resistance and also the resistance to plastic deformation. Addition of cubic carbides such as TiC, TaC and NbC is another mean to influence the tool properties, and large additions in combination with high binder phase contents can give relatively good toughness behavior. However, this addition can have a negative influence on comb crack formation and edge chipping tendencies.

Since it is obviously difficult to improve all tool properties simultaneously, commercial cemented carbide grades have usually been optimised with respect to one or few of the above mentioned wear types. Consequently, they have also been optimised for specific application areas.

U.S. Pat. No. 6,062,776 discloses a coated cutting insert particularly useful for milling of low and medium alloyed steels and stainless steels with raw surfaces such as cast skin, forged skin, hot or cold rolled skin or pre-machined surfaces under unstable conditions. The insert is characterised by a WC-Co cemented carbide with a low content of cubic carbides and a rather low W-alloyed binder phase and a coating including an innermost layer of $TiC_xN_yO_z$ with columnar grains and a top layer of TiN and an inner layer of $\kappa$-$Al_2O_3$.

U.S. Pat. No. 6,177,178 describes a coated milling insert particularly useful for milling in low and medium alloyed steels with or without raw surface zones during wet or dry conditions. The insert is characterised by a WC-Co cemented carbide with a low content of cubic carbides and a highly W-alloyed binder phase and a coating including an inner layer of $TiC_xN_yO_z$ with columnar grains, an inner layer of $\kappa$-$Al_2O_3$ and, preferably, a top layer of TiN.

U.S. Pat. No. 6,250,855 discloses a coated milling insert for wet or dry milling of stainless steels of different composition and microstructure. The coated WC-Co based cemented carbide inserts includes a specific composition range of WC-Co without any additions of cubic carbides, a low W-alloyed Co binder and a hard and wear resistant coating including a multilayered structure of sub-layers of the composition $(Ti_xAl_{1-x})N$.

EP 1103635 provides a cutting tool insert particularly useful for wet and dry milling of low and medium alloyed steels and stainless steels as well as for turning of stainless steels. The cutting tool is comprised of a cobalt cemented carbide substrate with a multi-layer refractory coating thereon. The substrate has a cobalt content of from about 9.0 to about 10.9 wt % and contains from about 1.0 to about 2.0 wt % TaC/NbC. The coating consists of an MTCVD $TiC_xN_yO_z$ layer and a multi-layer coating being composed of $\kappa$-$Al_2O_3$ and $TiC_xN_yO_z$ layers.

It has now been found that enhanced cutting performance can be obtained by combining many different features of the cutting tool. The cutting insert has excellent performance preferably for milling of stainless steels and super alloys, but also for steels in toughness demanding operations. At these cutting conditions, the cutting tool according to the invention displays improved properties with respect to many of the wear types mentioned earlier.

SUMMARY OF THE INVENTION

In one aspect, there is provided a cutting tool insert comprising a cemented carbide body and a coating particularly useful for milling of stainless steels and superalloys and milling of steels in toughness demanding applications, said body having a composition of from about 11.3 to about 12.7 wt % Co, from about 0.5 to about 2.5 wt % total amount of cubic carbides of the metals Ti, Nb and Ta and balance WC, the WC grains having a mean intercept length in the range from about 0.3 to about 0.8 μm, the binder phase being alloyed with W corresponding to a S-value within the range from about 0.81 to about 0.95, said coating comprising:

- a first (innermost) layer of $TiC_xN_yO_z$ with $0.7 \leqq x+y+z \leqq 1$ with equiaxed grains and a total thickness <1 μm;
- a layer of $TiC_xN_yO_z$ with $0.7 \leqq x+y+z \leqq 1$ with a thickness of from about 0.5 to about 5 μm with columnar grains; and
- a layer of $Al_2O_3$ comprising the $\alpha$-phase with a thickness of from about 0.2 to about 5 μm.

In another aspect, there is provided the use of cutting tool inserts as described above for milling of stainless steels and super alloys at cutting speeds of from about 30 to about 500 m/min with mean chip thickness values of from about 0.04 to about 0.25 mm, depending on cutting speed and insert geometry

DETAILED DESCRIPTION OF THE PREFERRED EMBODIMENTS OF THE INVENTION

Figure 1:
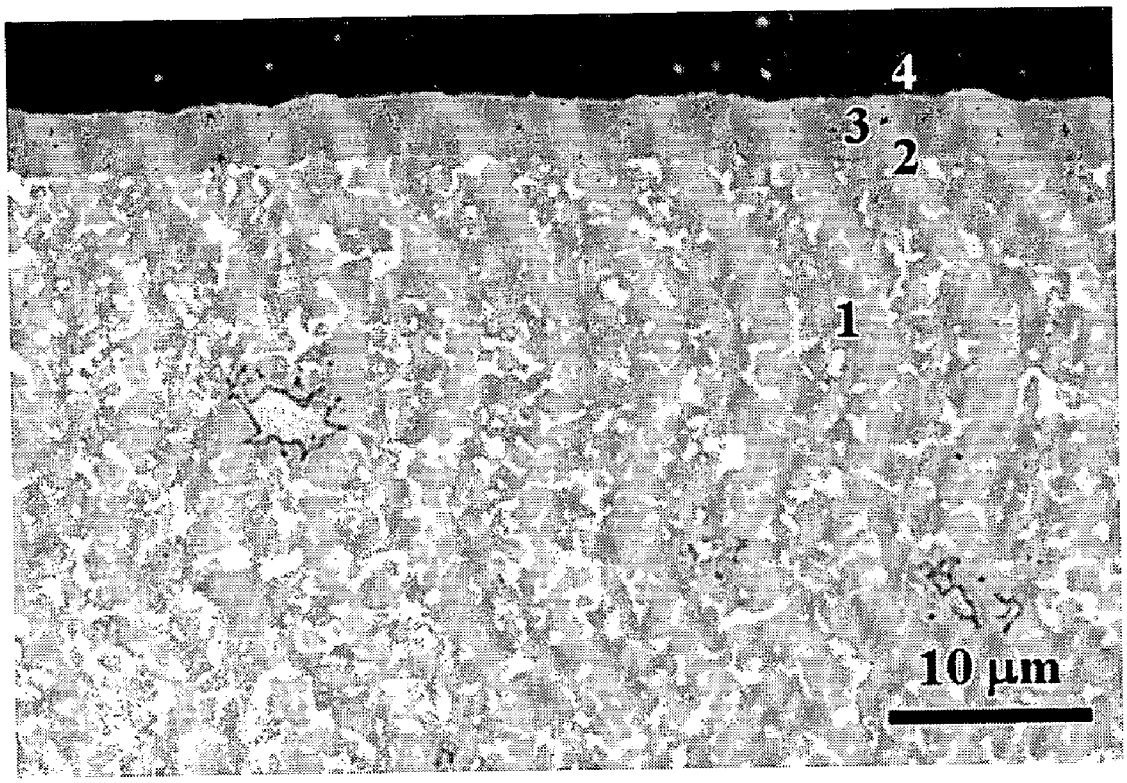
FIG. 1 shows in 2500× a coated cemented carbide insert according to the present invention in which 1. A cemented carbide body
2. An innermost $TiC_xN_yO_z$ layer
3. A $TiC_xN_yO_z$ layer with columnar grains
4. An $\alpha$-$Al_2O_3$ layer

The cutting tool insert according to the present invention includes a cemented carbide substrate with a relatively low amount of cubic carbides, with a medium to highly W-alloyed binder phase and a fine to medium WC grain size. This substrate is provided with a wear resistant coating comprising an equiaxed $TiC_xN_yO_z$ layer, a columnar $TiC_xN_yO_z$ layer, and at least one $\alpha$-$Al_2O_3$ layer.

According to the present invention, a coated cutting tool insert is provided with a cemented carbide body having a composition of from about 11.3 to about 12.7 wt % Co, preferably from about 11.5 to about 12.5 wt % Co, most preferably from about 11.8 to about 12.4 wt % Co; from about 0.5 to about 2.5 wt %, preferably from about 0.7 to about 1.9 wt %, most preferably from about 1.0 to about 1.8 wt % total amount of cubic carbides of the metals Ti, Nb and Ta; and balance WC. Ti, Ta and/or Nb may also be replaced by other carbides of elements from groups IVb, Vb or VIb of the periodic table. The content of Ti is preferably on a level corresponding to a technical impurity. In a preferred embodiment, the ratio between the weight concentrations of Ta and Nb is within from about 1.0 to about 12.0, preferably from about 1.5 to about 11.4, most preferably from about 3.0 to about 10.5.

The cobalt binder phase is medium to highly alloyed with tungsten. The content of W in the binder phase may be expressed as the S-value=$\sigma/16.1$, where $\sigma$ is the measured magnetic moment of the binder phase in $\mu Tm^3kg^{-1}$. The S-value depends on the content of tungsten in the binder phase and increases with a decreasing tungsten content. Thus, for pure cobalt, or a binder in a cemented carbide that is saturated with carbon, S=1, and for a binder phase that contains W in an amount that corresponds to the borderline to formation of $\eta$-phase, S=0.78.

It has now been found according to the present invention that improved cutting performance is achieved if the cemented carbide body has an S-value within the range from about 0.81 to about 0.95, preferably from about 0.82 to about 0.94, most preferably from about 0.85 to about 0.92.

Furthermore, the mean intercept length of the tungsten carbide phase measured on a ground and polished representative cross section is in the range from about 0.3 to about 0.8 μm, preferably from about 0.4 to about 0.8 μm. The intercept length is measured by means of image analysis on micrographs with a magnification of 10000× and calculated as the average mean value of approximately 1000 intercept lengths.

The coating according to a preferred embodiment comprises:

- a first (innermost) layer of $TiC_xN_yO_z$ with $0.7 \leqq x+y+z \leqq 1$, preferably $z<0.5$, more preferably $y>x$ and $z<0.2$, most preferably $y>0.7$, with equiaxed grains and a total thickness <1 μm preferably >0.1 μm.
- a layer of $TiC_xN_yO_z$ with $0.7 \leqq x+y+z \leqq 1$, preferably with $z<0.2$, $x>0.3$ and $y>0.2$, most preferably $x>0.4$, with a thickness of from about 0.5 to about 5 μm, preferably from about 1 to about 4 μm, most preferably from about 1.5 to about 3 μm, with columnar grains.
- a layer of $Al_2O_3$ consisting of the $\alpha$-phase. The $Al_2O_3$ layer has a thickness of from about 0.2 to about 5 μm, preferably from about 0.5 to about 4 μm, and most preferably from about 1 to about 3 μm.

In a further preferred embodiment, the cutting tool insert as described above is treated after coating with a wet blasting or brushing operation, such that the surface quality on the rake face of the coated tool is improved.

The present invention also relates to a method of making a coated cutting tool with a composition of from about 11.3 to about 12.7 wt % Co, preferably from about 11.5 to about 12.5 wt % Co, most preferably from about 11.8 to about 12.4 wt % Co; from about 0.5 to about 2.5 wt %, preferably from about 0.7 to about 1.9 wt %, most preferably from about 1.0 to about 1.8 wt % total amount of cubic carbides of the metals Ti, Nb and Ta and balance WC. Ti, Ta and/or Nb may also be replaced by other carbides of elements from groups IVb, Vb or VIb of the periodic table. The content of Ti is preferably on a level corresponding to a technical impurity. In a preferred embodiment, the ratio between the weight concentrations of Ta and Nb is within from about 1.0 to about 12.0, preferably from about 1.5 to about 11.4, most preferably from about 3.0 to about 10.5.

The desired mean intercept length depends on the grain size of the starting powders and milling and sintering conditions and has to be determined by experiments. The desired S-value depends on the starting powders and sintering conditions and also has to be determined by experiments.

The layer of $TiC_xN_yO_z$, with $0.75 \leqq x+y+z \leqq 1$, preferably with $z<0.2$, $x>0.3$ and $y>0.2$, most preferably $x>0.4$, having a morphology of columnar grains, is deposited with MTCVD-technique onto the cemented carbide using acetonitrile as the carbon and nitrogen source for forming the layer in the temperature range of from about 700 to about 950° C.

The innermost $TiC_xN_yO_x$, layer and alumina layers are deposited according to known technique.

The invention also relates to the use of cutting tool inserts according to the above for milling of stainless steels and super alloys at cutting speeds of from about 30 to about 500 m/min, preferably from about 50 to about 400 m/min, with mean chip thickness values of from about 0.04 to about 0.20 mm, depending on cutting speed and insert geometry.

The invention is additionally illustrated in connection with the following Examples, which are to be considered as illustrative of the present invention. It should be understood, however, that the invention is not limited to the specific details of the Examples.

EXAMPLE 1

Grade A: A cemented carbide substrate in accordance with the invention with the composition 12 wt % Co, 1.3 wt % TaC, 0.2 wt % NbC and balance WC, with a binder phase alloyed with W corresponding to an S-value of 0.90 was produced by conventional milling of powders, pressing of green compacts and subsequent sintering at 1430° C. Investigation of the microstructure after sintering showed that the mean intercept length of the tungsten carbide phase was 0.59 μm. The substrate was coated in accordance with the invention with a 0.2 μm thick layer of $TiC_xN_yO_z$ layer with z<0.1 and y>0.6, having equiaxed grains, a 2.5 μm thick layer of columnar $TiC_xN_yO_z$ deposited at from about 835 to about 850° C. with acetonitrile as carbon and nitrogen source, yielding an approximated carbon to nitrogen ratio x/y=1.5 with z<0.1, and a 1.2 μm thick layer of $\alpha$-$Al_2O_3$ deposited at approximately 1000° C. Analysis of the $Al_2O_3$ layer with XRD showed no traces of $\kappa$-$Al_2O_3$.

Grade B: A substrate with the same chemical composition and manufacturing route as the substrate of grade A (according to the invention) was prepared with a coarser WC powder, resulting in a mean intercept length of the WC phase of 0.70 μm. The substrate was coated according to grade A in accordance with the invention.

Grade C: A substrate with composition 12 wt % Co, 0.52 wt % Cr and balance WC, a binder phase alloyed with W corresponding to an S-value of 0.87, and a mean intercept length of WC in the sintered body of 0.58 μm was produced by conventional milling of powders, pressing of green compacts and subsequent sintering at 1430° C. was combined with a coating according to Grade A (according to the invention).

Inserts according to Grade A, Grade B and Grade C were tested in a face milling application where flood coolant was applied.

| | |
|---|---|
| Operation | Face milling |
| Cutter diameter | 80 mm |
| Work piece | Bar, 600 mm × 75 mm |
| Material | SS2333 |
| Insert type | SEKN1203 |
| Cutting speed | 300 m/min |
| Feed | 0.25 mm/tooth |
| Number of teeth | 6 |
| Depth of cut | 3.5 mm |
| Width of cut | 35 mm |
| Coolant | Yes |

| Results | Tool life (min) |
|---|---|
| Grade A (grade according to invention) | 10 |
| Grade B (grade according to invention) | 9 |
| Grade C (coating according to invention) | 6 |

The tool life was limited by chipping of the edges in connection to comb cracks. The test shows a small influence from the WC grain size and poor properties of materials with Cr added as a grain-growth inhibiting agent instead of cubic carbides like TaC and NbC.

EXAMPLE 2

Grade D: The substrate of Grade A (according to the invention) was coated with a 0.3 μm thick layer of $TiC_xN_yO_z$, having equiaxed grains, a 2.5 μm thick layer of columnar $TiC_xN_yO_z$, deposited at from about 835 to about 850° C. a 1.3 μm thick layer of $\kappa$-$Al_2O_3$ deposited at approximately 1000° C. XRD analysis of the coating showed no traces of the $\alpha$-$Al_2O_3$ phase $Al_2O_3$.

Inserts of Grade A and Grade D were tested in a face milling operation of an Inconel 718 component.

| | |
|---|---|
| Operation | Face milling |
| Cutter diameter | 63 mm |
| Work piece | Block |
| Material | Inconel 718 |
| Insert type | OFMT0504 |
| Cutting speed | 40 m/min |
| Feed | 0.12 mm/tooth |
| Number of teeth | 6 |
| Depth of cut | 2 mm |
| Width of cut | 38 mm |
| Coolant | Emulsion |
| Time of cut | 12 min |

| Results | Flank wear |
|---|---|
| Grade A (grade according to invention) | 0.15 mm |
| Grade D (substrate according to invention) | 0.20 mm |

The test was stopped before maximum tool life was achieved and the wear of the inserts was studied. The inserts of Grade A showed lower average flank wear then inserts of Grade D and in addition, the edge chipping tendencies were less pronounced on inserts of Grade A. I.e. inserts according to Grade A show better wear resistance and toughness behavior when compared to inserts according to Grade D.

EXAMPLE 3

Grade E: The substrate of Grade A (according to the invention) was coated with a coating structure according to Grade A with the addition of an outer 0.4 μm thick nitrogen-rich $TiC_xN_yO_z$ layer.

| | |
|---|---|
| Operation | Square shoulder milling |
| Work piece | Bar |
| Material | SS2333 |
| Insert type | APKT1604 |
| Cutting speed | 250 m/min |
| Cutter diameter | 25 mm |
| Feed | 0.28 mm/tooth |
| Number of teeth | 2 |
| Depth of cut | 2.5 mm |
| Width of cut | 3–12 mm |
| Coolant | No |

| Results | Tool life (min) |
|---|---|
| Grade A (grade according to invention) | 17 |
| Grade E (substrate according to invention) | 14 |

The tool life was limited by flank wear and edge chipping. When using inserts in Grade A, the tendency for chips adhering to the cutting inserts is much lower than when using inserts in Grade E. The poorer tool life of Grade E is due to more pronounced edge chipping occurring as a result of adhesive wear and re-cutting of chips.

EXAMPLE 4

Grade F: A commercial cemented carbide cutting insert from a competitor with the composition 10.5 wt % Co, 0.43 wt % Cr and balance WC. The binder phase is alloyed with W corresponding to an S-value of 0.91, and the mean intercept length of the WC is 0.6 μm. The insert is coated with 4.9 μm thick coating with alternating layers of TiN and $Ti_xAl_{1-x}N$.

| | |
|---|---|
| Operation | Face milling |
| Cutter diameter | 80 mm |
| Work piece | Bar, 300 mm × 80 mm |
| Material | SS2343 |
| Insert type | SEET13 |
| Cutting speed | 275 m/min |
| Feed | 0.17 mm/tooth |
| Number of teeth | 1 |
| Depth of cut | 4 mm |
| Width of cut | 50 mm |
| Coolant | No |
| Time of cut | 13 min |

| Results | Maximum flank wear |
|---|---|
| Grade A (grade according to invention) | 0.18 |
| Grade F (prior art) | 0.45 |

The wear of the inserts was measured when maximum tool life was reached for the worst grade.

The principles, preferred embodiments, and modes of operation of the present invention have been described in the foregoing specification. The invention, which is intended to be protected herein, however, is not to be construed as limited to the particular forms disclosed, since these are to be regarded as illustrative rather than restrictive. Variations and changes maybe made by those skilled in the art without departing from the spirit of the invention.

The invention claimed is:

1. A cutting tool insert comprising a cemented carbide body and a coating, said body having a composition of from about 11.3 to about 12.7 wt% Co, from about 0.5 to about 2.5 wt% total amount of cubic carbides of the metals Ti, Nb and Ta and balance WC, the WC grains having a mean intercept length in the range from about 0.3 to about 0.8 μm, the Co being alloyed with W corresponding to an S-value within the range from about 0.81 to about 0.95, said coating comprising:

a first (innermost) layer of $TiC_xN_yO_z$ with $0.7 \leqq x+y+z \leqq 1$, $0<z<0.5$, and $0<x<y$, with equiaxed grains and a total thickness <0.1 and <1 μm;

a layer of $TiC_xN_yO_z$ with $0.7 \leqq x+y+z \leqq 1$ with a thickness of from about 0.5 to about 5 μm with columnar grains; and a layer of $Al_2O_3$ comprising the α-phase with a thickness of from about 0.2 to about 5 μm.

2. The cutting tool insert of claim 1 wherein said body has a composition of from about 11.5 to about 12.5 wt% Co, from about 0.7 to about 1.9 wt% total amount of cubic carbides of the metals Ti, Nb and Ta and balance WC, the WC grains having a mean Intercept length In the range from about 0.4 to about 0.8 μm, the Co being alloyed with W corresponding to an S-value within the range from about 0.82 to about 0.94, said coating comprising:

said $TiC_xN_yO_z$ layer being $TiC_xN_yO_z$ with $z<0.2$, $x<0.3$ and $y<0.2$ with a thickness of from about 1 to about 4 μm with columnar grains; and said layer of $Al_2O_3$ comprising the α-phase having a thickness of from about 0.5 to about 4 μm.

3. The cutting tool insert of claim 2 wherein said body has a composition of from about 11.8 to about 12.4 wt% Co; from about 1.0 to about 1.8 wt% of cubic carbides and said coating comprising:

said first (innermost) layer being $TiC_xN_yO_z$ with $y<x$ and $z<0.2$;

said $TiC_xN_yO_z$ layer being $TiC_xN_yO_z$ with $x<0.4$, having a thickness of from about 1.5 to about 3 μm, with columnar grains; and said layer of $Al_2O_3$ of the α-phase having a thickness of from about 1 to about 3 μm.

4. The cutting tool insert of claim 3 wherein said first (innermost) layer comprises $TiC_xN_yO_z$ with $y<0.7$.

5. The cutting tool insert of claim 1 wherein a ratio between weight concentrations of Ta and Nb is from about 1.0 to about 12.0.

6. The cutting tool insert of claim 5 wherein the ratio is from about 1.5 to about 11.4.

7. The cutting tool insert of claim 6 wherein the ratio is from about 3.0 to about 10.5.

8. The cutting tool insert of claim 1 wherein the insert is for milling of stainless steels and superalloys and milling of steers in toughness demanding applications.

9. A method of removing material from a stainless steel or a super alloy, the method comprising:

milling stainless steel or super alloy with a cutting tool insert of claim 1 at cutting speeds of from about 30 to about 500 m/min with mean chip thickness values of from about 0.04 to about 0.25 mm, depending on cutting speed and insert geometry.

10. The method of claim 9 wherein milling stainless steel or super alloy is performed at cutting speeds of from about 50 to about 400 m/min.

* * * * *